US006692536B1

(12) United States Patent
Masschelein et al.

(10) Patent No.: US 6,692,536 B1
(45) Date of Patent: Feb. 17, 2004

(54) USE OF A CRYSTAL GROWTH INHIBITOR TO REDUCE FABRIC ABRASION

(75) Inventors: Axel Masschelein, Brussels (BE); Christiaan Arthur Jacques Kamiel Thoen, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/554,700

(22) PCT Filed: Nov. 20, 1998

(86) PCT No.: PCT/US98/24817

§ 371 (c)(1),
(2), (4) Date: Jun. 19, 2000

(87) PCT Pub. No.: WO99/27052

PCT Pub. Date: Jun. 3, 1999

(30) Foreign Application Priority Data

Nov. 24, 1997 (EP) ..... 97870188
Jun. 27, 1998 (EP) ..... 98202165

(51) Int. Cl.[7] ..... D06Q 1/02; D06M 1/02

(52) U.S. Cl. ..... 8/115.6; 8/115.51; 510/461; 510/508

(58) Field of Search ..... 510/220, 223, 510/224, 228, 375, 461, 508; 347/9; 8/115.51, 115.6

(56) References Cited

U.S. PATENT DOCUMENTS

| | | | | | |
|---|---|---|---|---|---|
| 5,376,300 | A | * | 12/1994 | Bolkan et al. | 252/174.14 |
| 5,518,646 | A | | 5/1996 | Van den Brom | 252/174 |
| 5,650,017 | A | * | 7/1997 | Gordon et al. | 134/7 |
| 5,726,280 | A | | 3/1998 | Uhr et al. | 528/328 |
| 5,827,808 | A | * | 10/1998 | Appleby et al. | 510/220 |
| 6,063,747 | A | * | 5/2000 | Warwick | 510/224 |
| 6,162,259 | A | * | 12/2000 | Williams | 8/137 |
| 6,177,393 | B1 | * | 1/2001 | McGregor et al. | 510/224 |
| 6,274,538 | B1 | * | 8/2001 | Addison | 510/224 |
| 6,303,561 | B1 | * | 10/2001 | Painter | 510/446 |

FOREIGN PATENT DOCUMENTS

| | | | | |
|---|---|---|---|---|
| EP | 506246 | | 9/1992 | C08F/22/02 |
| EP | 000735132 | A1 * | 10/1996 | C11D/3/08 |
| EP | 753565 | | 1/1997 | C11D/1/62 |
| NL | WO 98/25972 | * | 6/1998 | C08B/37/18 |
| WO | WO 95/29980 | | 11/1995 | C11D/3/386 |
| WO | WO 96/26999 | | 9/1996 | C11D/3/39 |

* cited by examiner

*Primary Examiner*—Yogendra N. Gupta
*Assistant Examiner*—D. G. Hamlin
(74) *Attorney, Agent, or Firm*—Julia A. Glazer; Richard S. Echler, Sr.; Kim W. Zerby

(57) ABSTRACT

There is provided the use of a crystal growth inhibitor for reducing the fabric abrasion occurring upon laundering treatment.

6 Claims, 1 Drawing Sheet

USE OF A CRYSTAL GROWTH INHIBITOR TO REDUCE FABRIC ABRASION

TECHNICAL FIELD OF THE INVENTION

Figure 1:
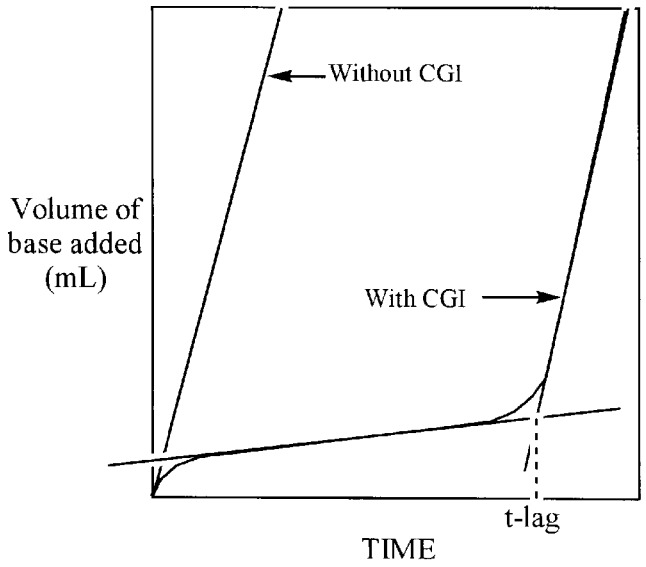

The present invention relates to the use of a crystal growth inhibitor for reducing the abrasion of fabrics arising upon laundering treatment.

BACKGROUND OF THE INVENTION

The appearance of fabrics, e.g., clothing, bedding, household fabrics such as table linens is one of the areas of concern for consumers. Indeed, upon typical consumer's uses of the fabrics such as wearing, washing, rinsing and/or tumble-drying of fabrics, a loss in the fabric appearance can take place. It has now been found that this loss is at least partly due to abrasion of the fabrics fibers upon laundering treatments. Such a problem of fabric abrasion is even more acute after multiwash cycles.

The solving of this problem has been achieved in the art by at least two ways either (i) remedying the fabric abrasion which has already occurred or by (ii) preventing the problem of fabric abrasion.

One solution for solving this problem by means of (i) is given in U.S. Pat. No. 3,894,318 whereby the fabric abrasion problem, which in turn results in a pilling effect on the fabric, is reduced by further abrading the fabric.

On the other hand, one solution for solving this problem by means of (ii) is by treating the fabric with polymeric substances which will deposit onto the fabric and and thus protect the fibers from abrasion. Typical disclosure can be found in U.S. Pat. No. 4,985,040 which provides firstly the deposition of a polyamide-epichlorhydrin resin and then that of a polyurethane.

Notwithstanding the advances in the art represented by the above disclosure, there is still a need for solutions that will provide efficient fabric abrasion reduction.

It has now been found that the use of a crystal growth inhibitor (CGI), in particular a limescale CGI, fulfills such a need.

By "efficient fabric abrasion reduction", it is meant that fabrics treated with the CGI exhibit an improved appearance due to a reduced fabric abrasion compared to untreated laundered fabrics.

Crystal growth inhibitors, in particular of the organic diphosphonic type have long been known in the art of detergent to reduce limescale build up to washing machine parts (e.g. heating resistance). A typical disclosure can be found in WO 97/05226 wherein the CGI ameliorates the white deposits problem caused by carbonate salts. Their use as a fabric abrasion reduction agent is not disclosed.

By "crystal growth inhibitor", it is meant a compound that reduces the rate of formation of inorganic microcrystals, thereby reducing the size and/or the amount of such microcrystals at the fabric surface.

It is therefore an advantage of the invention to provide the use of a crystal growth inhibitor for reducing fabric abrasion, in particular fabric abrasion which occur upon domestic laundering process.

SUMMARY OF THE INVENTION

The present invention relates to the use of a crystal growth inhibitor for reducing fabric abrasion, in particular fabric abrasion which arises upon the domestic laundering process of fabrics.

DETAILED DESCRIPTION OF THE INVENTION

Crystal Growth Inhibitor

A crystal growth inhibitor is the essential component of the invention.

The suitable CGI for use herein can be defined by the following test procedure, so called crystal growth inhibition test measurement.

Crystal Growth Inhibition Test Measurement

The ability for a compound to inhibit crystal growth can be assessed by evaluating the impact in vitro on the growth rate of inorganic micro-crystals. For this purpose, a system developed by G. H. Nancollas in 1964, described in Nancollas, G. H and Koutsoukos, P. G. "Calcium Phosphate Nucleation and Growth in solution." *Prog. Crystal Growth Charact.* 3, 77–102 (1980) can be used. This system consists of measuring the growth rate of calcium phosphate crystals seeded with hydroxyapatite ($[Ca_5(PO_4)_3OH]$ or HAP) in the presence of $CaCl_2$ and $NaH_2PO_4$. Calcium phosphate growth liberates protons that can be titrated with a strong base. The amount of base needed to keep the pH constant over the crystal growth enables persons skilled in the art to measure the crystal growth rate directly as well as to determine the effects of potential crystal growth rate inhibitors. A typical plot of such an experiment is given in FIG. 1.

The observed t-lag value defines the efficiency of a compound to inhibit the growth of calcium phosphate crystals; wherein the higher the t-lag, the better the CGI.

The following procedure can be used to build the plot given experimentally in FIG. 1.

Place 350 mL of distilled water (distilled twice), 35 mL of KCl 2.1M, 50 mL of $CaCl_2$ 0.0175M and 50 mL of $KH_2PO_4$ 0.01M in a reaction vessel. Insert a glass pH electrode and a standard calomel reference electrode connected to an auto-titrator. Bubble nitrogen gas and stabilize the temperature of the reaction mixture to 37° C. When temperature and pH are stabilized, add the CGI candidate at the concentration to be tested (e.g. $1.10^{-6}$M). Titrate to pH 7.4 with KOH 0.05M. Then seed the reaction mixture with 5 mL of hydroxyapatite slurry $[Ca_5(PO_4)OH]$.

The hydroxyapatite slurry is prepared as follows:

100 gr of Bio-Gel® HTP hydroxyapatite powder is dispersed in 1 L of distilled water. The pH of the resulting slurry is lowered to 2.5 by dropwise addition of HCl 6N. This is then heated to boiling and refluxed while stirring for seven days in a 2 L round-bottom flask connected to a condenser. After cooling, to room temperature, pH is adjusted to 12.0 by dropwise addition of 50% NaOH and the slurry is refluxed for another seven days as before. The slurry is allowed to settle for two days and the supernatant is suctioned off. The flask is refilled with 1.5 L of distilled water, stirred vigorously, an allowed to settle again for two days. A total of seven rinses as described above are performed. The pH is adjusted to 7.o by dropwise addition of HCl 2N while stirring vigorously. The resulting slurry is stored at 37° C. for eleven months.

The plot shown above is obtained by recording the amount of base added over time to maintain the pH of the reaction medium. T-lag for a particular crystal growth inhibitor is determined graphically as described in the figure above.

The crystal growth inhibitors to be used for the purpose of this invention have a t-lag of at least 10 minutes at a concentration of $1.10^{-6}$M, preferably at least 20 minutes, most preferably at least 50 minutes.

Still another suitable method for determining the crystal growth inhibition property of the selected component which is comparable to the T-lag method is by a visual grading. The method is as follows: A multicycle laundry test is performed over several (e.g. 10) cycles of repeated washing and tumble drying. The conditions used are representative for the desired geographical region (e.g. domestic washing machine used, detergent used, rinse added product use, water hardness, clothing articles washed etc.). At least two test legs are run in parallel, including the composition of the invention and a separate reference leg. After the required number of washing cycles have been performed the test garments (articles of clothing) are taken for comparison by expert graders under controlled lighting conditions. The visual grading is a better/worse comparison of the visible crystalline residue on the surface of the test garments, comparing the test leg to the reference leg. Dark coloured, knitted cotton articles are most suitable for this comparison.

In addition, the crystal growth inhibitors, differentiate themselves from the chelating agents by their low binding affinity for copper defined by its Log K, i.e. the ML/M.L Log K at 25C., 0.1 ionic strength, of the CGI is of less than 15, preferably less than 12.

Preferably, the CGI for use in the present invention are selected from carboxylic compounds, organic monophosphonic acids, organic diphosphonic acids, and mixtures thereof.

Carboxylic Compounds

Typical of carboxylic compound for use herein are the carboxylic compounds selected from glycolic acid, phytic acid, monomeric polycarboxylic acids, homo or copolymeric polycarboxylic acids or their salts in which the polycarboxylic acid comprises at least two carboxylic radicals separated from each other by not more than two carbon atoms.

When utilised in salt form, alkali metals, such as sodium, potassium and lithium, or alkanolammonium salts are preferred.

Organic detergent CGIs suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate CGI can generally be added to the composition in acid form, but can also be added in the form of a neutralised salt. When utilized in salt form, alkali metals, such as sodium, potassium, and lithium, or alkanolammonium salts are preferred.

Included among the polycarboxylate CGIs are a variety of categories of useful materials. One important category of polycarboxylate CGIs encompasses the ether polycarboxylates, including oxydisuccinate, as disclosed in U.S. Pat. Nos. 3,128,287 and 3,635,830. See also "TMS/TDS" CGIs of U.S. Pat. No. 4,663,071. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful CGI include the ether hydroxypolycarboxylates, polyacrylate polymers, copolymers of maleic anhydride with ethylene or vinyl methyl ether, or acrylic acid, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

The molecular weight for these polymers and copolymers is preferably below 100,000, most preferably between 500 and 50,000.

Commercially available polymers, suitable for use herein, which prevent the precipitation of the salts of the buffering component upon dilution of the composition in water are the polyacrylate polymers sold under the tradename Good-Rite® from BF Goodrich, Acrysol® from Rohm & Haas, Sokalan® from BASF, Norasol® from Norso Haas. Preferred commercially available polymers are the polyacrylate polymers, especially the Norasol® polyacrylate polymers and more preferred are the polyacrylate polymer Norasol® 410N (MW 10,000) and the polyacrylate polymer modified with aminophosphonic groups Norasol® 440N (MW 4000) and its corresponding acid form Norasol® QR 784 (MW 4000) from Norso-Haas.

Citrates, e.g., citric acid and soluble salts thereof (particularly sodium salt), are polycarboxylate CGI suitable for use herein.

Also suitable in the compositions containing the present invention are the 3,3-dicarboxy4-oxa-1,6-hexanedioates and the related compounds disclosed in U.S. Pat. No. 4,566,984. Useful succinic acid CGI include the $C_5$–$C_{20}$ alkyl and alkenyl succinic acids and salts thereof. A particularly preferred compound of this type is dodecenylsuccinic acid. Specific examples of succinate CGIs include: laurylsuccinate, myristylsuccinate, paimitylsuccinate, 2-dodecenylsuccinate (preferred), 2-pentadecenylsuccinate, and the like. Laurylsuccinates are the preferred CGIs of this group, and are described in EP 0,200,263. Other suitable polycarboxylates are disclosed in U.S. Pat. No. 4,144,226 and in U.S. Pat. No. 3,308,067. See also U.S. Pat. No. 3,723,322.

Organic Monophosphonic Acid

Organo monophosphonic acid or one of its salts or complexes is also suitable for use herein as a CGI.

By organo monophosphonic acid it is meant herein an organo monophosphonic acid which does not contain nitrogen as part of its chemical structure. This definition therefore excludes the organo aminophosphonates, which however may be included in compositions of the invention as heavy metal ion sequestrants.

The organo monophosphonic acid component may be present in its acid form or in the form of one of its salts or complexes with a suitable counter cation. Preferably any salts/complexes are water soluble, with the alkali metal and alkaline earth metal salts/complexes being especially preferred.

A prefered organo monophosphonic acid is 2-phosphonobutane-1,2,4-tricarboxylic acid commercially available from Bayer under the tradename of Bayhibit.

Organodiphosphonic Acid

Organo diphosphonic acid or one of its salts or complexes is also suitable for use herein as a CGI.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrants.

The organo diphosphonic acid component may be present in its acid form or in the form of one of its salts or complexes with a suitable counter cation. Preferably any salts/complexes are water soluble, with the alkali metal and alkaline earth metal salts/complexes being especially preferred.

The organo diphosphonic acid is preferably a $C_1$–$C_4$ diphosphonic acid and more preferably a $C_2$ diphosphonic acid selected from ethylene diphosphonic acid, α-hydroxy-2 phenyl ethyl diphosphonic acid, methylene diphosphonic acid, vinylidene 1,1 diphosphonic acid, 1,2 dihydroxyethane 1,1 diphosphonic acid and hydroxy-ethane 1,1 diphosphonic acid and any salts thereof and mixtures thereof.

A most preferred organo diphosphonic acid is hydroxyethane 1,1 diphosphonic acid (HEDP).

Among the above described classes of CGI, preferred classes for use herein are the class of organic monophosphonic acids and/or organic diphosphonic acids.

The CGI can be employed in stand alone product including pre-or post-wash additives. It can also be employed It can also be used in fully-formulated compositions including laundry compositions as well as rinse added fabric softener compositions and dryer added compositions (e.g. sheets) which provide softening and/or antistatic benefits, and rinse added compositions.

Typical levels of incorporation of the CGI within the compositions is of less than 10%, preferably less than 1%, more preferably from 0.005% to 0.5%, most preferably from 0.05% to 0.25%, and even most preferably from 0.1% to 0.2% by weight of the composition.

Selection of the components typical for use in such fully formulated compositions is made depending on their end use. For example, when formulated as a softening composition, it will comprises a fabric softening compound.

Fabric Softening Compound

Typical levels of incorporation of the softening compound in the softening composition are of from 1% to 80% by weight, preferably from 5% to 75%, more preferably from 15% to 70%, and even more preferably from 19% to 65%, by weight of the composition.

The fabric softener compound is preferably selected from a cationic, nonionic, amphoteric or anionic fabric softening component. Typical of the cationic softening components are the quaternary ammonium compounds or amine precursors thereof as defined hereinafter.

A)-Quatemary Ammonium Fabric Softening Active Compound (1) Preferred quaternary ammonium fabric softening active compound have the formula

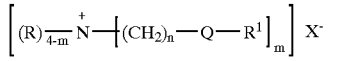

(1)

or the formula:

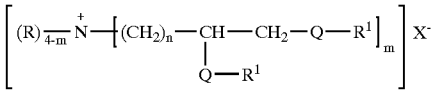

(2)

wherein Q is a carbonyl unit having the formula:

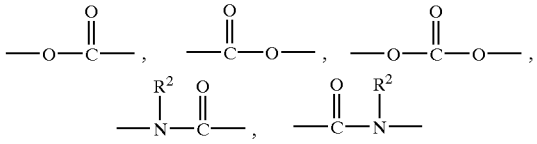

each R unit is independently hydrogen, $C_1$–$C_6$ alkyl, $C_1$–$C_6$ hydroxyalkyl, and mixtures thereof, preferably methyl or hydroxy alkyl; each $R^1$ unit is independently linear or branched $C_{11}$–$C_{22}$ alkyl, linear or branched $C_{11}$–$C_{22}$ alkenyl, and mixtures thereof, $R^2$ is hydrogen, $C_1$–$C_4$ alkyl, $C_1$–$C_4$ hydroxyalkyl, and mixtures thereof; X is an anion which is compatible with fabric softener actives and adjunct ingredients; the index m is from 1 to 4, preferably 2; the index n is from 1 to 4, preferably 2.

An example of a preferred fabric softener active is a mixture of quaternized amines having the formula:

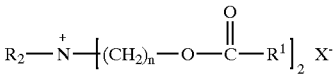

wherein R is preferably methyl; $R^1$ is a linear or branched alkyl or alkenyl chain comprising at least 11 atoms, preferably at least 15 atoms. In the above fabric softener example, the unit $—O_2CR^1$ represents a fatty acyl unit which is typically derived from a triglyceride source. The triglyceride source is preferably derived from tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures of these oils.

The preferred fabric softening actives of the present invention are the Diester and/or Diamide Quaternary Ammonium (DEQA) compounds, the diesters and diamides having the formula:

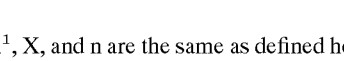

wherein R, $R^1$, X, and n are the same as defined herein above for formulas (1) and (2), and Q has the formula:

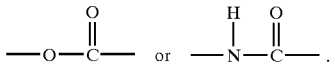

These preferred fabric softening actives are formed from the reaction of an amine with a fatty acyl unit to form an amine intermediate having the formula:

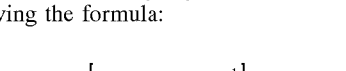

wherein R is preferably methyl, Q and $R^1$ are as defined herein before; followed by quaternization to the final softener active.

Non-limiting examples of preferred amines which are used to form the DEQA fabric softening actives according to the present invention include methyl bis(2-hydroxyethyl) amine having the formula:

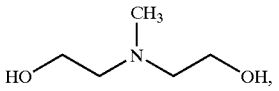

methyl bis(2-hydroxypropyl)amine having the formula:

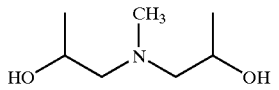

methyl (3-aminopropyl) (2-hydroxyethyl)amine having the formula:

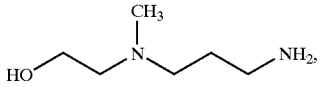

methyl bis(2-aminoethyl)amine having the formula:

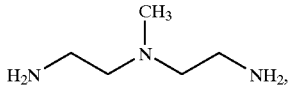

triethanol amine having the formula:

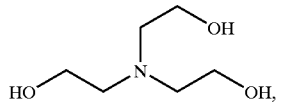

di(2-aminoethyl) ethanolamine having the formula:

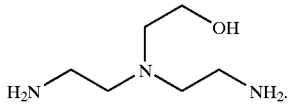

The counterion, $X^{(-)}$ above, can be any softener-compatible anion, preferably the anion of a strong acid, for example, chloride, bromide, methylsulfate, ethylsulfate, sulfate, nitrate and the like, more preferably chloride or methyl sulfate. The anion can also, but less preferably, carry a double charge in which case $X^{(-)}$ represents half a group.

Tallow and canola oil are convenient and inexpensive sources of fatty acyl units which are suitable for use in the present invention as $R^1$ units. The following are non-limiting examples of quaternary ammonium compounds suitable for use in the compositions of the present invention. The term "tallowyl" as used herein below indicates the $R^1$ unit is derived from a tallow triglyceride source and is a mixture of fatty acyl units. Likewise, the use of the term canolyl refers to a mixture of fatty acyl units derived from canola oil.

TABLE II

| Fabric Softener Actives |
|---|
| N,N-di(tallowyl-oxy-ethyl)-N,N-dimethyl ammonium chloride; |
| N,N-di(canolyl-oxy-ethyl)-N,N-dimethyl ammonium chloride; |
| N,N-di(tallowyl-oxy-ethyl)-N-methyl, N-(2-hydroxyethyl) ammonium chloride; |
| N,N-di(canolyl-oxy-ethyl)-N-methyl, N-(2-hydroxyethyl) ammonium chloride; |
| N,N-di(2-tallowyloxy-2-oxo-ethyl)-N,N-dimethyl ammonium chloride; |
| N,N-di(2-canolyloxy-2-oxo-ethyl)-N,N-dimethyl ammonium chloride |
| N,N-di(2-tallowyloxyethylcarbonyloxyethyl)-N,N-dimethyl ammonium chloride; |
| N,N-di(2-canolyloxyethylcarbonyloxyethyl)-N,N-dimethyl ammonium chloride; |
| N-(2-tallowoyloxy-2-ethyl)-N-(2-tallowyloxy-2-oxo-ethyl)-N,N-dimethyl ammonium chloride; |
| N-(2-canolyloxy-2-ethyl)-N-(2-canolyloxy-2-oxo-ethyl)-N,N-dimethyl ammonium chloride; |
| N,N,N-tri(tallowyl-oxy-ethyl)-N-methyl ammonium chloride; |
| N,N,N-tricanolyl-oxy-ethyl)-N-methyl ammonium chloride; |
| N-(2-tallowyloxy-2-oxoethyl)-N-(tallowyl)-N,N-dimethyl ammonium chloride; |
| N-(2-canolyloxy-2-oxoethyl)-N-(canolyl)-N,N-dimethyl ammonium chloride; |
| 1,2-ditallowyloxy-3-N,N,N-trimethylammoniopropane chloride; and |
| 1,2-dicanolyloxy-3-N,N,N-trimethylammoniopropane chloride; |
| and mixtures of the above actives. |

Other examples of quaternary ammonium softening compounds are methylbis(tallowamidoethyl)(2-hydroxyethyl) ammonium methylsulfate and methylbis(hydrogenated tallowamidoethyl)(2-hydroxyethyl)ammonium methylsulfate; these materials are available from Witco Chemical Company under the trade names Varisoft® 222 and Varisoft® 110, respectively.

Particularly preferred is N,N-di(tallowoyl-oxy-ethyl)-N,N-dimethyl ammonium chloride, where the tallow chains are at least partially unsaturated.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished, having a IV below or above 25.

Indeed, for compounds having the formula:

$$\left[(R)_{4-m}\overset{+}{N}-[(CH_2)_n-Q-R^1]_m\right]\ X^-$$

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentrability. For compounds of this type made from tallow fatty acids having a Iodine Value of above 25, the ratio of cis to trans isomers has been found to be less critical unless very high concentrations are needed. Other suitable examples of fabric softener actives are derived from fatty acyl groups wherein the terms "tallowyl" and canolyl" in the above examples are replaced by the terms "cocoyl, palmyl, lauryl, oleyl, ricinoleyl, stearyl, paimityl," which correspond to the triglyceride source from which the fatty acyl units are derived. These alternative fatty acyl sources can comprise either fully saturated, or preferably at least partly unsaturated chains.

As described herein before, R units are preferably methyl, however, suitable fabric softener actives are described by replacing the term "methyl" in the above examples in Table II with the units "ethyl, ethoxy, propyl, propoxy, isopropyl, butyl, isobutyl and t-butyl.

The counter ion, X, in the examples of Table II can be suitably replaced by bromide, methylsulfate, formate, sulfate, nitrate, and mixtures thereof. In fact, the anion, X, is merely present as a counterion of the positively charged quaternary ammonium compounds. The scope of this invention is not considered limited to any particular anion.

For the preceding ester fabric softening agents, the pH of the compositions herein is an important parameter of the present invention. Indeed, it influences the stability of the quaternary ammonium or amine precursors compounds, especially in prolonged storage conditions. The pH, as defined in the present context, is measured in the neat compositions at 20° C. While these compositions are operable at pH of less than about 6.0, for optimum hydrolytic stability of these compositions, the neat pH, measured in the above-mentioned conditions, must preferably be in the range of from about 2.0 to about 5, preferably in the range of 2.5 to 4.5, preferably about 2.5 to about 3.5. The pH of these compositions herein can be regulated by the addition of a Bronsted acid. Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids. The use of the ethoxylated amino-functional-polymers in this context is particularly beneficial. Indeed, as stated herein before, the softening compositions are preferably used in the pH ranges above mentioned, that is acidic conditions. In such acidic conditions, ethoxylated amino-functional polymers which have not been treated so as to eliminate the aldehydes and/or ketones present within the raw material will produce these undesirable by-product thus producing a malodour and discoloration. With the amino-functional polymer of the invention, this is not so, the polymer are stable upon acidic conditions and so is their resulting odor and color.

As used herein, when the diester is specified, it will include the monoester that is normally present in manufacture. For softening, under no/low detergent carry-over laundry conditions the percentage of monoester should be as low as possible, preferably no more than about 2.5%. However, under high detergent carry-over conditions, some monoester is preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in the manufacturing of the softener compound.

Mixtures of actives of formula (1) and (2) may also be prepared.

2)-Still other suitable quatemary ammonium fabric softening compounds for use herein are cationic nitrogenous salts having two or more long chain acyclic aliphatic $C_8$–$C_{22}$ hydrocarbon groups or one said group and an arylalkyl group which can be used either alone or as part of a mixture are selected from the group consisting of:

(i) acyclic quaternary ammonium salts having the formula:

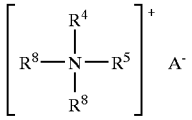

wherein $R^4$ is an acyclic aliphatic $C_8$–$C_{22}$ hydrocarbon group, $R^5$ is a $C_1$–$C_4$ saturated alkyl or hydroxyalkyl group, $R^8$ is selected from the group consisting of $R^4$ and $R^5$ groups, and A– is an anion defined as above;

(ii) diamino alkoxylated quaternary ammonium salts having the formula:

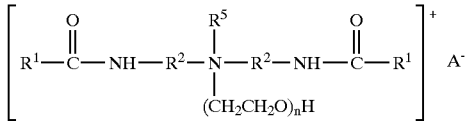

wherein n is equal to 1 to about 5, and $R^1$, $R^2$, $R^5$ and $A^-$ are as defined above;

(iii) mixtures thereof.

Examples of the above class cationic nitrogenous salts are the well-known dialkyldi methylammonium salts such as ditallowdimethylammonium chloride, ditallowdimethylammonium methylsulfate, di(hydrogenatedtallow) dimethylammonium chloride, distearyldimethylammonium chloride, dibehenyidimethylammonium chloride. Di(hydrogenatedtallow)di methylammonium chloride and ditallowdimethylammonium chloride are preferred. Examples of commercially available dialkyldimethyl ammonium salts usable in the present invention are di(hydrogenatedtallow)dimethylammonium chloride (trade name Adogen® 442), ditallowdimethylammonium chloride (trade name Adogen® 470, Praepagen® 3445), distearyl dimethylammonium chloride (trade name Arosurf® TA-100), all available from Witco Chemical Company. Dibehenyldimethylammonium chloride is sold under the trade name Kemamine Q-2802C by Humko Chemical Division of Witco Chemical Corporation. Dimethylstearylbenzyl ammonium chloride is sold under the trade names Varisoft® SDC by Witco Chemical Company and Ammonyx® 490 by Onyx Chemical Company.

B)-Amine Fabric Softening Active Compound

Suitable amine fabric softening compounds for use herein, which may be in amine form or cationic form are selected from:

(i)-Reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines. The preferred Component (i) is a nitrogenous compound selected from the group consisting of the reaction product mixtures or some selected components of the mixtures. One preferred component (i) is a compound selected from the group consisting of substituted imidazoline compounds having the formula:

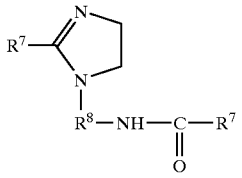

wherein $R^7$ is an acyclic aliphatic $C_{15}$–$C_{21}$ hydrocarbon group and $R^8$ is a divalent $C_1$–$C_3$ alkylene group.

Component (i) materials are commercially available as: Mazamide® 6, sold by Mazer Chemicals, or Ceranine® HC, sold by Sandoz Colors & Chemicals; stearic hydroxyethyl imidazoline sold under the trade names of Alkazine® ST by Alkaril Chemicals, Inc., or Schercozoline® S by Scher Chemicals, Inc.; N,N"-ditallowalkoyldiethylenetriamine; 1-tallowamidoethyl-2-tallowimidazoline (wherein in the preceding structure $R^1$ is an aliphatic $C_{15}$–$C_{17}$ hydrocarbon group and $R^8$ is a divalent ethylene group).

Certain of the Components (i) can also be first dispersed in a Bronsted acid dispersing aid having a pKa value of not greater than about 4; provided that the pH of the final composition is not greater than about 6. Some preferred dispersing aids are hydrochloric acid, phosphoric acid, or methylsulfonic acid.

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N"-ditallow alkoyldiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

(ii)-softener having the formula:

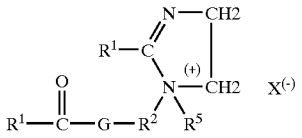

wherein each $R^2$ is a $C_{1-6}$ alkylene group, preferably an ethylene group; and G is an oxygen atom or an —NR— group; and each R, $R^1$, $R^2$ and $R^5$ have the definitions given above and $A^-$ has the definitions given above for $x^-$.

An example of Compound (ii) is 1-oleylamidoethyl-2-oleylimidazolinium chloride wherein $R^1$ is an acyclic aliphatic $C_{15}$–$C_{17}$ hydrocarbon group, $R^2$ is an ethylene group, G is a NH group, $R^5$ is a methyl group and $A^-$ is a chloride anion.

(iii)-softener having the formula:

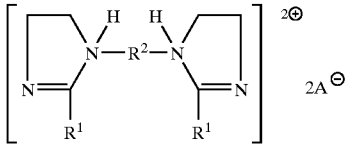

wherein R, $R^1$, $R^2$, and $A^-$ are defined as above.

An example of Compound (iii) is the compound having the formula:

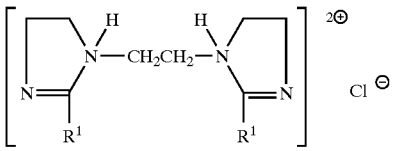

wherein $R^1$ is derived from oleic acid.

Additional fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. No. : 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; U.S. Pat. No. 4,237,016, Rudkin, Clint, and Young; and European Patent Application publication No. 472,178, by Yamamura et al., all of said documents being incorporated herein by reference. Of course, the term "softening active" can also encompass mixed softening active agents. Preferred among the classes of softener compounds disclosed herein before are the diester or diamido quaternary ammonium fabric softening active compound (DEQA).

The invention composition may contain, in addition or alternatively to the herein before described components, one or more of the following ingredients.

Optional Ingredients (A)-Liquid carrier

An optional, but preferred, ingredient is a liquid carrier. The liquid carrier employed in the instant compositions is preferably at least primarily water due to its low cost, relative availability, safety, and environmental compatibility. The level of water in the liquid carrier is preferably at least about 50%, most preferably at least about 60%, by weight of the carrier. Mixtures of water and low molecular weight, e.g., <about 200, organic solvent, e.g., lower alcohols such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

(B)-Additional Solvents

The compositions of the present invention may comprise one or more solvents which provide increased ease of formulation. These ease of formulation solvents are all disclosed in WO 97/03169. This is particularly the case when formulating liquid, clear fabric softening compositions. When employed, the ease of formulation solvent system preferably comprises less than about 40%, preferably from about 10% to about 35%, more preferably from about 12% to about 25%, and even more preferably from about 14% to about 20%, by weight of the composition. The ease of formulation solvent is selected to minimize solvent odor impact in the composition and to provide a low viscosity to the final composition. For example, isopropyl alcohol is not very effective and has a strong odor. n-Propyl alcohol is more effective, but also has a distinct odor. Several butyl alcohols also have odors but can be used for effective clarity/stability, especially when used as part of a ease of formulation solvent system to minimize their odor. The alcohols are also selected for optimum low temperature stability, that is they are able to form compositions that are liquid with acceptable low viscosities and translucent, preferably clear, down to about 40° F. (about 4.4° C.) and are able to recover after storage down to about 20° F. (about minus 6.7° C.).

The suitability of any ease of formulation solvent for the formulation of the liquid, concentrated, preferably clear, fabric softener compositions herein with the requisite stability is surprisingly selective. Suitable solvents can be selected based upon their octanol/water partition coefficient (P) as defined in WO 97/03169.

The ease of formulation solvents herein are selected from those having a ClogP of from about 0.15 to about 0.64, preferably from about 0.25 to about 0.62, and more preferably from about 0.40 to about 0.60, said ease of formulation solvent preferably being at least somewhat asymmetric, and preferably having a melting, or solidification, point that allows it to be liquid at, or near room temperature. Solvents that have a low molecular weight and are biodegradable are also desirable for some purposes. The more asymmetric solvents appear to be very desirable, whereas the highly symmetrical solvents such as 1,7-heptanediol, or 1,4-bis (hydroxymethyl) cyclohexane, which have a center of symmetry, appear to be unable to provide the essential clear compositions when used alone, even though their ClogP values fall in the preferred range. The most preferred ease of formulation solvents can be identified by the appearance of the softener vesicles, as observed via cryogenic electron microscopy of the compositions that have been diluted to the concentration used in the rinse. These dilute compositions appear to have dispersions of fabric softener that exhibit a more uni-lamellar appearance than conventional fabric softener compositions. The closer to uni-lamellar the appearance, the better the compositions seem to perform. These compositions provide surprisingly good fabric softening as compared to similar compositions prepared in the conventional way with the same fabric softener active.

Operable ease of formulation solvents are disclosed and listed below which have ClogP values which fall within the requisite range. These include mono-ols, C6 diols, C7 diols, octanediol isomers, butanediol derivatives, trimethylpentanediol isomers, ethylmethylpentanediol isomers, propyl pentanediol isomers, dimethylhexanediol isomers, ethylhexanediol isomers, methylheptanediol isomers, octanediol isomers, nonanediol isomers, alkyl glyceryl ethers, di(hydroxy alkyl) ethers, and aryl glyceryl ethers, aromatic glyceryl ethers, alicyclic diols and derivatives, $C_3C_7$ diol alkoxylated derivatives, aromatic diols, and unsaturated diols. Particularly preferred ease of formulation solvents include hexanediols such as 1,2-Hexanediol and 2-Ethyl-1,3-hexanediol and pentanediols such as 2,2,4-Trimethyl-1,3-pentanediol.

(C)-Dispersibility Aids

Relatively concentrated compositions containing both saturated and unsaturated diester quaternary ammonium compounds can be prepared that are stable without the addition of concentration aids. However, the compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1) single long chain alkyl cationic surfactants; (2) nonionic surfactants; (3) amine oxides; (4) fatty acids; and (5) mixtures thereof. These aids are described in WO 94/20597, specifically on page 14, line 12 to page 20, line 12, which is herein incorporated by reference. When said dispersibility aids are present the total level is from 2% to 25%, preferably from 3% to 17%, more preferably from 4% to 15%, and even more preferably from 5% to 13% by weight of the composition. These materials can either be added as part of the active softener raw material, (I), e.g., the mono-long chain alkyl cationic surfactant and/or the fatty acid which are reactants used to form the biodegradable fabric softener active as discussed hereinbefore, or added as a separate component. The total level of dispersibility aid includes any amount that may be present as part of component (I).

Inorganic viscosity/dispersibility control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition. Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes. Specific examples of alkylene polyammonium salts include I-lysine monohydrochloride and 1,5-diammonium 2-methyl pentane dihydrochloride.

(D)-Dye fixing agent

The composition of the invention may optionally comprise a dye fixing agent. Dye fixing agents, or "fixatives", are well-known, commercially available materials which are designed to improve the appearance of dyed fabrics by minimizing the loss of dye from fabrics due to washing. Not included within this definition are components which are fabric softeners or those described hereinbefore as amino-functional polymers.

Many dye fixing agents are cationic, and are based on various quaternized or otherwise cationically charged organic nitrogen compounds. Cationic fixatives are available under various trade names from several suppliers. Representative examples include: CROSCOLOR PMF (July 1981, Code No. 7894) and CROSCOLOR NOFF (January 1988, Code No. 8544) from Crosfield; INDOSOL E-50 (Feb. 27, 1984, Ref. No. 6008.35.84; polyethyleneamine-based) from Sandoz; SANDOFIX TPS, which is also available from Sandoz and is a preferred polycationic fixative for use herein and SANDOFIX SWE (cationic resinous compound), REWIN SRF, REWIN SRF-O and REWIN DWR from CHT-Beitlich GMBH, Tinofix® ECO, Tinofix® FRD and Solfin® available from Ciba-Geigy.

Other cationic dye fixing agents are described in "After-treatments for improving the fastness of dyes on textile fibres" by Christopher C. Cook (REV. PROG. COLORATION Vol. 12, 1982). Dye fixing agents suitable for use in the present invention are ammonium compounds such as fatty acid—diamine condensates e.g. the hydrochloride, acetate, metosulphate and benzyl hydrochloride of oleyldiethyl aminoethylamide, oleylmethyldiethylenediaminemethosulphate, monostearyl-ethylene diaminotrimethylammonium methosulphate and oxidized products of tertiary amines; derivatives of polymeric alkyldiamines, polyamine-cyanuric chloride condensates and aminated glycerol dichlorohydrins.

A typical amount of the dye fixing agent to be employed in the composition of the invention is preferably up 90% by weight, preferably up to 50% by weight, more preferably from 0.001% to 10% by weight, most preferably from 0.5% to 5% active by weight of the composition.

(E)-Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions for the compositions and compounds stored in molten form. The use of antioxidants and reductive agent stabilizers is especially critical for low scent products (low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT (butylated hydroxytoluene), BHA (butylated hydroxyanisole), propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone. The chemical names and CAS numbers for some of the above stabilizers are listed in Table II below.

TABLE II

| Antioxidant | CAS No. | Chemical Name used in Code of Federal Regulations |
|---|---|---|
| Irganox ® 1010 | 6683-19-8 | Tetrakis (methylene(3,5-di-tert-butyl-4 hydroxyhydrocinnamate)) methane |
| Irganox ® 1035 | 41484-35-9 | Thiodiethylene bis(3,5-di-tert-butyl-4-hydroxyhydrocinnamate |
| Irganox ® 1098 | 23128-74-7 | N,N'-Hexamethylene bis(3,5-di-tert-butyl-4-hydroxyhydrocinnamamide |
| Irganox ® B 1171 | 31570-04-4<br>23128-74-7 | 1:1 Blend of Irganox ® 1098 and Irgafos ® 168 |
| Irganox ® 1425 | 65140-91-2 | Calcium bis(monoethyl(3,5-di-tert-butyl-4-hydroxybenzyl)phosphonate) |
| Irganox ® 3114 | 65140-91-2 | Calcium bis(monoethyl(3,5-di-tert-butyl-4-hydroxybenzyl)phosphonate) |
| Irganox ® 3125 | 34137-09-2 | 3,5-Di-tert-butyl-4-hydroxy-hydrocinnamic acid triester with 1,3,5-tris(2-hydroxyethyl)-S-triazine-2,4,6-(1H, 3H, 5H)-trione |
| Irgafos ® 168 | 31570-04-4 | Tris(2,4-di-tert-butyl-phenyl)phosphite |

Examples of reductive agents include sodium borohydride, hypophosphorous acid, Irgafos® 168, and mixtures thereof.

(F)-Soil Release Agent

Any polymeric soil release agent known to those skilled in the art can optionally be employed in the compositions of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10.0%, by weight, of the detergent compositions herein, typically from about 0.1% to about 5%, preferably from about 0.2% to about 3.0%.

The following, all included herein by reference, describe soil release polymers suitable for use in the present invention. U.S. Pat. No. 3,959,230 Hays, issued May 25, 1976; U.S. Pat. No. 3,893,929 Basadur, issued Jul. 8, 1975; U.S. Pat. No. 4,000,093, Nicol, et al., issued Dec. 28, 1976; U.S. Pat. No. 4,702,857 Gosselink, issued Oct. 27, 1987; U.S. Pat. No. 4,968,451, Scheibel et al., issued November 6; U.S. Pat. No. 4,702,857, Gosselink, issued Oct. 27, 1987; U.S. Pat. No. 4,711,730, Gosselink et al., issued Dec. 8, 1987; U.S. Pat. No. 4,721,580, Gosselink, issued Jan. 26, 1988; U.S. Pat. No. 4,877,896,Maldonado et al., issued Oct. 31, 1989; U.S. Pat. No. 4,956,447, Gosselink et al., issued Sep. 11, 1990; U.S. Pat. No. 5,415,807 Gosselink et al., issued May 16, 1995; European Patent Application 0 219 048, published Apr. 22, 1987 by Kud, et al.

Further suitable soil release agents are described in U.S. Pat. No. 4,201,824, Violland et al.; U.S. Pat. No. 4,240,918 Lagasse et al.; U.S. Pat. No. 4,525,524 Tung et al.; U.S. Pat. No. 4,579,681, Ruppert et al.; U.S. Pat. Nos. 4,240,918; 4,787,989; 4,525,524; EP 279,134 A, 1988, to Rhone-Poulenc Chemie; EP 457,205 A to BASF (1991); and DE 2,335,044 to Unilever N. V., 1974 all incorporated herein by reference.

Commercially available soil release agents include the METOLOSE SM100, METOLOSE SM200 manufactured by Shin-etsu Kagaku Kogyo K. K., SOKALAN type of material, e.g., SOKALAN HP-22, available from BASF (Germany), ZELCON 5126 (from Dupont) and MILEASE T (from ICI).

(G)-Bactericides

Examples of bactericides used in the compositions of this invention include glutaraldehyde, formaldehyde, 2-bromo-2-nitro-propane-1,3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon 1 to 1,000 ppm by weight of the agent.

(H)-Perfume

The present invention can contain a perfume. Suitable perfumes are disclosed in U.S. Pat. No. 5,500,138, said patent being incorporated herein by reference. As used herein, perfume includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

The range of the natural raw substances can embrace not only readily-volatile, but also moderately-volatile and slightly-volatile components and that of the synthetics can include representatives from practically all classes of fragrant substances, as will be evident from the following illustrative compilation: natural products, such as tree moss absolute, basil oil, citrus fruit oils (such as bergamot oil, mandarin oil, etc.), mastix absolute, myrtle oil, palmarosa oil, patchouli oil, petitgrain oil Paraguay, wormwood oil, alcohols, such as farnesol, geraniol, linalool, nerol, phenylethyl alcohol, rhodinol, cinnamic alcohol, aldehydes, such as citral, Helional™, alpha-hexyl-cinnamaldehyde, hydroxycitronellal, Lilial™ (p-tert-butyl-alpha-methyidihydrocinnamaldehyde), methylnonylacetaldehyde, ketones, such as allylionone, alpha-ionone, beta-ionone, isoraldein (isomethyl-alpha-ionone), methylionone, esters, such as allyl phenoxyacetate, benzyl salicylate, cinnamyl propionate, citronellyl acetate, citronellyl ethoxolate, decyl acetate, dimethylbenzylcarbinyl acetate, dimethylbenzylcarbinyl butyrate, ethyl acetoacetate, ethyl acetylacetate, hexenyl isobutyrate, linalyl acetate, methyl dihydrojasmonate, styrallyl acetate, vetiveryl acetate, etc., lactones, such as gamma-undecalactone, various components often used in perfumery, such as musk ketone, indole, p-menthane-8-thiol-3-one, and methyl-eugenol. Likewise, any conventional fragrant acetal or ketal known in the art can be added to the present composition as an optional component of the conventionally formulated perfume (c). Such conventional fragrant acetals and ketals include the well-known methyl and ethyl acetals and ketals, as well as acetals or ketals based on benzaldehyde, those comprising phenylethyl moieties, or more recently developed specialties such as those described in a United States Patent entitled "Acetals and Ketals of Oxo-Tetralins and Oxo-Indanes, see U.S. Pat. No. 5,084,440, issued Jan. 28, 1992, assigned to Givaudan Corp. Of course, other recent synthetic specialties can be included in the perfume compositions for fully-formulated fabric softening compositions. These include the enol ethers of alkyl-substituted oxo-tetralins and oxo-indanes as described in U.S. Pat. No. 5,332,725, Jul. 26, 1994, assigned to Givaudan; or Schiff Bases as described in U.S. Pat. No. 5,264,615, Dec. 9, 1991, assigned to Givaudan.

The perfumes useful in the present invention compositions are substantially free of halogenated materials and nitromusks.

Perfume can be present at a level of from 0% to 10%, preferably from 0.1% to 5%, and more preferably from 0.2% to 3%, by weight of the finished composition. Fabric softener compositions of the present invention provide improved fabric perfume deposition.

(I)-Enzyme

The compositions and processes herein can optionally employ one or more enzymes such as lipases, proteases, cellulase, amylases and peroxidases.

A preferred enzyme for use herein is a cellulase enzyme. Indeed, this type of enzyme will further provide a color care benefit to the treated fabric. Cellulases usable herein include both bacterial and fungal types, preferably having a pH optimum between 5 and 9.5. U.S. Pat. No. 4,435,307 discloses suitable fungal cellulases from Humicola insolens or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® and CELLUZYME® (Novo) are especially useful. Other suitable cellulases are also disclosed in WO 91/17243 to Novo, WO 96/34092, WO 96/34945 and EP-A-0,739,982. In practical terms for current commercial preparations, typical amounts are up to 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from 0.5 to 1000 CEVU/gram of composition. Cellulase enzyme preparations used for the purpose of formulating the compositions of this invention typically have an activity comprised between 1,000 and 10,000 CEVU/gram in liquid form, around 1,000 CEVU/gram in solid form.

(J)-Other Optional Ingredients

The present invention composition can include optional components conventionally used in fully formulated laundry detergent compositions such as described in WO 97/05226, for example builders, bleaches, brighteners, colorants; surfactants; anti-shrinkage agents; fabric crisping agents; spotting agents; germicides; fungicides; anti-oxidants such as butylated hydroxy toluene, anti-corrosion agents, antifoam agents, polyamino functional polymer such as disclosed in co-pending application EP 97201488.0, dispersible polyolefin such as Velustrol® as disclosed in co-pending application PCT/US 97/01644, and the like. The present invention can also contain optional chelating agents.

A typical amount of such optional components will be from 0% to 15% by weight.

The present invention can also include other compatible ingredients, including those as disclosed in WO96/02625, WO96/21714, and WO96/21715.

Reduction of the Fabric Abrasion

The benefit provided by the use of the present invention is that the fabric abrasion which arises on fabrics, upon a laundering process, is reduced, e.g. it is meant that laundered fabrics which are in contact with a CGI or composition thereof exhibit a reduced fabric abrasion versus fabrics which are in contact with no CGI or no CGI containing-composition but still laundered.

Not to be bound by theory, it is believed that the mechanism for producing the benefit of the invention is due to the abrasive effect of inorganic micro-crystals growing at the fabric surface upon laundering in the absence of CGI. The source of inorganic compounds is believed to be the feed water of the laundering process as well as the soil present on the laundered garments.

The fabric abrasion reduction benefit is visually assessed using the following fabric reduction test method:

Fabric Reduction Test Method

The compositions according to the present invention may be measured for fabric reduction by laundering a cotton terry over repeated cycles (e.g. 20 cycles) respectively with and without CGI.

The method is comparative and thus only one fabric's abrasion respective to another may be tested at any one time. The fabric abrasion is evaluated using the following scale:

0 No fabric abrasion
1 Very weak fabric abrasion
2 Weak fabric abrasion
3 Moderate fabric abrasion
4 Strong fabric abrasion
5 Very strong fabric abrasion In another aspect of the invention, there is provided a method for reducing the fabric abrasion, in particular upon domestic laundering processes, which comprises the steps of contacting the fabrics with a CGI or a composition thereof as defined hereinbefore. Most preferably, the application of the CGI to the fabric surface is made upon the rinsing step of a laundry process. More preferably, the CGI is incorporated in fabric softening compositions.

In the exemplified compositions, the abbreviated component identifications have the following meanings:

| | |
|---|---|
| DEQA | Di-(tallowyl-oxy-ethyl) dimethyl ammonium chloride |
| DOEQA | Di-(oleyloxyethyl) dimethyl ammonium methylsulfate |
| DTDMAC | Ditallow dimethylammonium chloride |
| DHEQA | Di-(soft-tallowyl-oxy-ethyl) hydroxyethyl methyl ammonium methylsulfate |
| Fatty acid | tallow fatty acid IV = 18 |
| Electrolyte | Calcium chloride |
| DTDMAMS | Ditallow dimethyl ammonium methylsulfate |
| SDASA | 1:2 Ratio of stearyldimethyl amine: triple-pressed stearic acid |
| Glycosperse S-20 | Polyethoxylated sorbitan monostearate available from Lonza |
| Clay | Calcium Bentonite Clay, Bentonite L, sold by Southern Clay Products |
| TAE25 | Tallow alcohol ethoxylated with 25 moles of ethylene oxide per mole of alcohol |
| PEG | Polyethylene Glycol 4000 |
| PEI 1200 E4 | Ethoxylated polyethylene imine (MW 1800, at 50% active) as synthesised in Synthesis example 2 |

-continued

| | |
|---|---|
| PEI 1800 E7 | Ethoxylated polyethylene imine (MW 1800, at 50% active) as synthesised as per Synthesis example 1 |
| PEI 1200 E1 | Ethoxylated polyethylene imine (MW 1200, at 50% active in water) as synthesised in Synthesis example 2 |
| Dye Fix 1 | Cationic dye fixing agent (50% active) available under the tradename Tinofix Eco from Ciba-Geigy |
| Dye Fix 2 | Emulsified cationic dye fixative (30% active) available under the tradename Rewin SRF-O from CHT-Beitlich |
| LAS | Sodium linear $C_{12}$ alkyl benzene sulphonate |
| TAS | Sodium tallow alcohol sulphate |
| C25AS | Sodium $C_{12}$–$C_{15}$ linear alkyl sulphate |
| CxyEzS | Sodium $C_{1x}$–$C_{1y}$ branched alkyl sulphate condensed with z moles of ethylene oxide |
| C45E7 | A $C_{14-15}$ predominantly linear primary alcohol condensed with an average of 7 moles of ethylene oxide |
| C25 E3 | A $C_{12-15}$ branched primary alcohol condensed with an average of 3 moles of ethylene oxide |
| Cationic ester | Mixture of $C_{12}/C_{14}$ choline ester |
| Soap | Sodium linear alkyl carboxylate derived from an 80/20 mixture of tallow and a coconut oils. |
| TFM | $C_{16}$–$C_{18}$ alkyl N-methyl glucamide |
| TPKFA | C12–C14 topped whole cut fatty acids |
| Zeolite A | Hydrated Sodium Aluminosilicate of formula $Na_{12}(A10_2SiO_2)_{12}.27\ H_2O$ having a primary particle size in the range from 0.1 to 10 micrometers |
| Citric acid | Anhydrous citric acid |
| Carbonate | Anhydrous sodium carbonate with a particle size between 200 $\mu$m and 900 $\mu$m |
| Silicate | Amorphous Sodium Silicate ($SiO_2$:$Na_2O$; 2.0 ratio) |
| Sulphate | Anhydrous sodium sulphate |
| Citrate | Tri-sodium citrate dihydrate of activity 86.4% with a particle size distribution between 425 $\mu$m and 850 $\mu$m |
| MA/AA | Copolymer of 1:4 maleic/acrylic acid, average molecular weight about 70,000. |
| CMC | Sodium carboxymethyl cellulose |
| Savinase | Proteolytic enzyme of activity 4 KNPU/g |
| Carezyme | Cellulytic enzyme of activity 1000 CEVU/g |
| Termamyl | Amylolytic enzyme of activity 60 KNU/g |
| Lipolase | Lipolytic enzyme of activity 100 kLU/g all sold by NOVO Industries A/S and of activity mentioned above unless otherwise specified |
| PB4 | Sodium perborate tetrahydrate of nominal formula $NaBO_2.3\ H_2O.H_2O_2$ |
| PB1 | Anhydrous sodium perborate bleach of nominal formula $NaBO_2.H_2O_2$ |
| TAED | Tetraacetyl ethylene diamine |
| DTPMP | Diethylene triamine penta (methylene phosphonate), marketed by Monsanto under the Trade name Dequest 2060 |
| HEDP | 1,1-hydroxyethane diphosphonic acid |
| PBT | 2-phosphonobutane-1,2,4-tricarboxylic acid |
| Polycarboxylic | Polycarboxylic compound marketed by BASF under the tradename Sokalan CP 10 |
| Glycolic | Glycolic acid |
| Photoactivated bleach | Sulphonated Zinc Phthalocyanin encapsulated in dextrin soluble polymer |
| Brightener | Disodium 4,4'-bis(4-anilino-6-morpholino-1.3.5-triazin-2-yl)amino) stilbene-2:2'-disulphonate. |
| Silicone antifoam controller | Polydimethyldiloxane foam controller with Siloxane-oxyalkylene copolymer as dispersing agent with a ratio of said foam to said dispersing agent of 10:1 to 100:1. |

Synthesis Example 1—Preparation of PEI 1800 $E_1$

Step A)

The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored. A 750 g portion of polyethyleneimine (PEI) (Nippon Shokubai, Epomin SP-018 having a listed average molecular weight of 1800 equating to 0.417 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Step B)

The reaction mixture is then deodorized by passing about 100 cu. ft. of inert gas (argon or nitrogen) through a gas dispersion frit and through the reaction mixture while agitating and heating the mixture to 130° C.

The final reaction product is cooled slightly and collected in glass containers purged with nitrogen. In other preparations the neutralization and deodorization is accomplished in the reactor before discharging the product.

If a PEI 1800 $E_7$ is desired, the following step of catalyst addition will be included between Step A and B. Vacuum is continuously applied while the autoclave is cooled to about 50° C. while introducing 376 g of a 25% sodium methoxide in methanol solution (1.74 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes. Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 4500 g of ethylene oxide (resulting in a total of 7 moles of ethylene oxide per mole of PEI nitrogen function) is achieved over several hours, the temperature is increased to 110° C. and the mixture stirred for an additional hour. The reaction mixture is then collected in nitrogen purged containers and eventually transferred into a 22 L three neck round bottomed flask equipped with heating and agitation. The strong alkali catalyst is neutralized by adding 167 g methanesulfonic acid (1.74 moles).

Other preferred examples such as PEI 1800 E2, PEI 1800 E4, PEI 1800 E15 and PEI 1800 E20 can be prepared by the above method by adjusting the reaction time and the relative amount of ethylene oxide used in the reaction.

Synthesis Example 2—Preparation of PEI 1200 $E_1$

Step A)

The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored. A 750 g portion of polyethyleneimine (PEI) (having a listed average molecular weight of 1200 equating to about 0.625 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Step B)

The reaction mixture is then deodorized by passing about 100 cu. ft. of inert gas (argon or nitrogen) through a gas dispersion frit and through the reaction mixture while agitating and heating the mixture to 130° C. The final reaction product is cooled slightly and collected in glass containers purged with nitrogen.

In other preparations the neutralization and deodorization is accomplished in the reactor before discharging the product.

If a PEI 1200 $E_7$ is desired, the following step of catalyst addition will be included between Step A and B. Vacuum is continuously applied while the autoclave is cooled to about 50° C. while introducing 376 g of a 25% sodium methoxide in methanol solution (1.74 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes. Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 4500 g of ethylene oxide (resulting in a total of 7 moles of ethylene oxide per mole of PEI nitrogen function) is achieved over several hours, the temperature is increased to 110° C. and the mixture stirred for an additional hour. The reaction mixture is then collected in nitrogen purged containers and eventually transferred into a 22 L three neck round bottomed flask equipped with heating and agitation. The strong alkali catalyst is neutralized by adding 167 g methanesulfonic acid (1.74 moles).

Other preferred examples such as PEI 1200 E2, PEI 1200 E3, PEI 1200 E15 and PEI 1200 E20 can be prepared by the above method by adjusting the reaction time and the relative amount of ethylene oxide used in the reaction.

EXAMPLE 1

Using the test method defined above, fabrics were contacted with an aqueous liquid composition comprising 2% by weight of HEDP and thereafter fabric abrasion was measured.

It was observed that fabrics treated with the CGI exhibited less fabric abrasion versus compositions that were not treated.

EXAMPLE 2

Similar results are obtained when the following compositions were used.

| Component | A | B | C | D | E | F | G | H |
|---|---|---|---|---|---|---|---|---|
| DEQA | 2.6 | 2.9 | 18.0 | 19.0 | 19.0 | — | — | — |
| TAE25 | | — | 1.0 | — | — | — | — | — |
| Fatty acid | 0.3 | — | 1.0 | — | — | — | — | — |
| Hydrochloride acid | 0.02 | 0.02 | 0.02 | 0.02 | 0.02 | — | — | — |
| PEG | — | — | 0.6 | 0.6 | 0.6 | — | — | — |
| Perfume | 1.0 | 1.0 | 1.0 | 1.0 | 1.0 | 0.1 | 0.1 | 0.1 |
| Silicone antifoam | 0.01 | 0.01 | 0.01 | 0.01 | 0.01 | — | — | — |
| PEI 1200 E1 | 3 | 3 | 3 | 3 | — | 15 | — | 10 |
| PEI 1200 E2 | — | | | | 3 | | 10 | — |
| Dye fix 1 | — | 1 | 1 | 1 | — | — | 10 | — |
| Dye fix 2 | — | 2 | 2 | 2 | — | — | — | — |
| HEDP | 0.2 | — | — | 0.2 | — | 0.4 | — | 0.8 |
| Glycolic | — | 0.2 | — | — | 0.5 | — | 0.4 | — |
| Polycarboxylate | — | — | 0.5 | — | — | 0.4 | — | — |
| Electrolyte (ppm) | — | — | 600 | 600 | 1200 | — | — | — |
| Dye (ppm) | 10 | 10 | 50 | 50 | 50 | — | — | — |
| Water and minors to balance to 100 | | | | | | | | |

-continued

| Component | I | J | K | L | M |
|---|---|---|---|---|---|
| DEQA | 2.6 | 19.0 | — | — | — |
| Fatty acid | 0.3 | — | — | — | — |
| Hydrochloride acid | 0.02 | 0.02 | — | — | — |
| PEG | — | 0.6 | — | — | — |
| Perfume | 1.0 | 1.0 | 0.1 | 0.1 | 0.2 |
| Silicone antifoam | 0.01 | 0.01 | — | — | — |
| PEI 1200 E1 | 3 | 3 | 15 | — | 10 |
| PEI 1200 E4 | — | — | — | 10 | — |
| Dye fix 1 | — | 1 | — | — | 2.5 |
| Dye fix 2 | — | 2 | — | — | — |
| PBT | 0.2 | 0.2 | 0.4 | 0.8 | 0.5 |
| Polycarboxylate | — | — | 0.4 | — | — |
| Electrolyte (ppm) | — | 600 | — | — | — |
| Dye (ppm) | 10 | 50 | — | — | — |
| Water and minors to balance to 100 | | | | | |

| Component | N | O | P | Q | R | S |
|---|---|---|---|---|---|---|
| DTDMAC | — | — | — | 15 | — | — |
| DEQA | 2.6 | 19.0 | — | — | 2.6 | 19.0 |
| TAE25 | 0.3 | — | — | — | 0.3 | — |
| Fatty acid | 0.3 | — | — | — | 0.3 | — |
| Hydrochloride acid | 0.02 | 0.02 | — | 0.02 | 0.02 | 0.02 |
| PEG | — | 0.6 | — | 0.6 | — | 0.6 |
| Perfume | 1.0 | 1.0 | 0.1 | 1.0 | 1.0 | 1.0 |
| Silicone antifoam | 0.01 | 0.01 | — | 0.01 | 0.01 | 0.01 |
| PEI 1800 E1 | 3 | 3 | 10 | 3 | 3 | 3 |
| HEDP | 0.2 | 0.2 | — | — | — | — |
| PBT | — | — | — | — | 0.2 | 0.2 |
| Glycolic | — | — | 0.2 | — | — | — |
| polycarboxylic | — | — | — | 0.2 | — | — |
| Dye fix 1 | 1 | 1 | 10 | 1 | 1 | 1 |
| Dye fix 2 | 2 | 2 | — | 2 | 2 | 2 |
| Electrolyte (ppm) | — | 600 | — | 600 | — | 600 |
| Dye (ppm) | 10 | 50 | — | 50 | 10 | 50 |
| Water and minors to balance to 100 | | | | | | |

EXAMPLE 3

Similar results are obtained when the following compositions for use as dryer-added sheets were used.

| | T | U | V | W | X | Y | Z | AA | BB |
|---|---|---|---|---|---|---|---|---|---|
| DOEQA | 40 | 40 | 25 | — | — | — | — | — | — |
| DHEQA | — | — | — | 20 | 20 | — | — | — | — |
| DTDMAMS | — | — | — | — | — | 20 | 20 | 12 | 60 |
| SDASA | 30 | 30 | 30 | 20 | 20 | 30 | 30 | 20 | — |
| Glycosperse S-20 | — | — | — | 10 | 10 | — | — | — | — |
| Glycerol Monostearate | — | — | — | — | — | 20 | 20 | 10 | — |
| Clay | 4 | 4 | 4 | 3 | 3 | 4 | 4 | 4 | — |
| Perfume | 0.7 | 0.7 | 1.1 | 0.7 | 0.7 | 1.6 | 1.6 | 2.6 | 1.4 |
| PEI 1800 E4 | — | — | 5 | — | — | — | — | — | — |
| PEI 1200 E1 | — | — | — | 4 | 4 | 2.2 | 2.2 | — | — |
| PEI 1800 E3 | 2 | 2 | — | — | — | — | — | 5 | 7.0 |
| Dye fix 1 | 2 | 2 | 5 | 4 | 4 | 2.2 | 2.2 | 5 | 3 |
| HEDP | 0.2 | — | — | 0.5 | — | — | — | — | 0.7 |
| BPT | — | 0.2 | — | — | 0.9 | — | 0.2 | | |
| Glycolic | — | — | 0.2 | — | — | 0.2 | — | — | — |
| Polycarboxylic | — | — | 0.2 | — | — | — | — | 0.4 | — |
| Stearic acid to balance | | | | | | | | | |

EXAMPLE 4

Similar results are obtained with the following detergent compositions.

| | CC | DD | EE |
|---|---|---|---|
| Zeolite A | 24.0 | 23.0 | 23.0 |
| Sulphate | 9.0 | — | — |
| MA/AA | 4.0 | 4.0 | 4.0 |
| LAS | 8.0 | 8.0 | 8.0 |
| TAS | — | 2.0 | 2.0 |
| Silicate | 3.0 | 3.0 | 3.0 |
| CMC | 1.0 | 0.4 | 0.4 |
| Brightener | 0.2 | — | — |
| Soap | 1.0 | — | — |
| DTPMP | 0.4 | 0.4 | 0.4 |
| C45E7 | 2.5 | 2.0 | 2.0 |
| C25E3 | 2.5 | 2.0 | 2.0 |
| Silicone antifoam | 0.3 | 5.0 | 5.0 |
| Perfume | 0.3 | 0.3 | 0.3 |
| Carbonate | 13.0 | 16.0 | 16.0 |
| Citrate | — | 5.0 | 5.0 |
| PB4 | 18.0 | — | — |
| PB1 | 4.0 | 14.0 | 14.0 |
| TAED | 3.0 | 6.0 | 6.0 |
| Photoactivated bleach | 0.02% | — | — |
| Savinase | 1.0 | 1.0 | 1.0 |
| Lipolase | 0.4 | 0.4 | 0.4 |
| Termamyl | 0.30 | 0.6 | 0.6 |
| Carezyme | — | 0.6 | 0.6 |
| PEI 1800 E7 AO | 1.0 | — | — |
| PEI 1200 E7 AO | — | 1.0 | 1.0 |
| HEDP | 0.2 | — | — |
| BPT | — | — | 0.2 |
| Glycolic | — | 0.2 | 0.2 |
| Polycarboxylic | — | 0.2 | 0.2 |

Balance (Moisture and Miscellaneous) to 100

EXAMPLE 5

Similar results are obtained with the following liquid detergent compositions.

| | FF |
|---|---|
| C25AS | 13 |
| C25E3S | 2 |

-continued

| | FF |
|---|---|
| TFAA | 6 |
| C12-14 alkyl dimethylhydroxy ethyl ammonium chloride | 1 |
| Cationic ester | 1.5 |
| TPKFA | 15 |
| Citric acid | 1 |
| Ethanol | 2 |
| 1,2 Propanediol | 8 |
| NaOH up to pH | 7.5 |
| DTPMP | 1.2 |
| Savinase | 0.5 |
| Termamyl (300 KNU/g) | 0.15 |
| Boric acid | 1.5 |
| Softening clay of the bentonite type | 4 |
| Suspending clay SD3 | 0.3 |
| PEI 1200 E7 | 1 |
| HEDP | 0.2 |
| Balance (Moisture and Miscellaneous) | 100 |

What is claimed is:

1. A method for reducing fabric abrasion, which comprises the steps of contacting the fabrics with a crystal growth inhibitor wherein said crystal inhibitor is selected from glycolic acid, phytic acid, oxydisuccinate, mellitic acid, succinic acid, oxydisuccinic acid, polymaleic acid, benzene 1,3,5-tricarboxylic acid, carboxymethyloxysuccinic acid, ether hydroxypolycarboxylates, organic diphosphonic acid, and mixtures thereof.

2. A method according to claim 1, wherein said carboxylic compound is glycolic acid.

3. A method according to claim 1, wherein said organo diphosphonic acid is hydroxy-ethane 1,1 diphosphonic acid.

4. A method according to claim 3, wherein said crystal growth inhibitor is incorporated into compositions at a level off than 10%.

5. A method according to claim 4, wherein said crystal growth inhibitor is incorporated into compositions at a level from about 0.05% to about 0.25%.

6. A method according to claim 4, wherein said composition is selected from pre- or post wash additives, laundry compositions, rinsing compositions of a laundry process, rinse added fabric softener compositions, and dryer added compositions.

* * * * *

UNITED STATES PATENT AND TRADEMARK OFFICE

CERTIFICATE OF CORRECTION

PATENT NO. : 6,692,536 B1
DATED : February 17, 2004
INVENTOR(S) : Axel Masschelein et al.

It is certified that error appears in the above-identified patent and that said Letters Patent is hereby corrected as shown below:

Column 26,
Line 36, should read -- of less than 10%. --

Signed and Sealed this

Twenty-ninth Day of June, 2004

JON W. DUDAS
*Acting Director of the United States Patent and Trademark Office*